US006522229B2

(12) United States Patent
Laine et al.

(10) Patent No.: US 6,522,229 B2
(45) Date of Patent: Feb. 18, 2003

(54) TRANSFORMER

(75) Inventors: Sakari Laine, Vaasa (FI); Kari Seppänen, Merikaarto (FI); Timo Rintamäki, Vaasa (FI)

(73) Assignee: ABB Technology AG, Zurich (CH)

( * ) Notice: Subject to any disclaimer, the term of this patent is extended or adjusted under 35 U.S.C. 154(b) by 0 days.

(21) Appl. No.: 09/969,103

(22) Filed: Oct. 3, 2001

(65) Prior Publication Data

US 2002/0057157 A1 May 16, 2002

Related U.S. Application Data

(63) Continuation of application No. PCT/FI00/00395, filed on May 4, 2000.

(30) Foreign Application Priority Data

May 5, 1999 (FI) ..... 991032

(51) Int. Cl.[7] ..... H01F 27/06

(52) U.S. Cl. ..... 336/65; 336/65; 336/90; 336/57; 336/58; 174/11 R

(58) Field of Search ..... 336/65, 90, 92, 336/100, 57, 58; 174/11 R, 15.1, 50

(56) References Cited

U.S. PATENT DOCUMENTS 4,453,197 A 6/1984 Burrage
4,472,700 A * 9/1984 Gentzkow ..... 336/57
4,901,182 A * 2/1990 Book ..... 361/38
5,177,325 A * 1/1993 Giammanco ..... 174/50
5,527,988 A 6/1996 Hernandez et al.
6,114,624 A * 9/2000 Ghafourian ..... 174/50

FOREIGN PATENT DOCUMENTS

CH 631039 7/1982
DE 3529911 3/1986

* cited by examiner

*Primary Examiner*—Michael Friedhofer
*Assistant Examiner*—Jennifer A Poker
(74) *Attorney, Agent, or Firm*—Dykema Gossett, PLLC

(57) ABSTRACT

The invention relates to a transformer tank generally shaped like a rectangular prism and filled with insulating liquid and assembled mainly by welding. The tank comprises a detachably fastened transformer cover plate and a transformer core placed in the transformer tank while the cover plate is detached. In accordance with the invention, at least one of the substantially vertical walls of the transformer tank comprises a detachable wall portion whose detachment allows the transformer core to be removed from the transformer tank through an opening formed by the detachment of the wall portion. In this way the transformer can be repaired on site without having to lift the transformer core from the transformer tank in the conventional manner, which would require free space above the transformer.

5 Claims, 1 Drawing Sheet

TRANSFORMER

Figure 1:
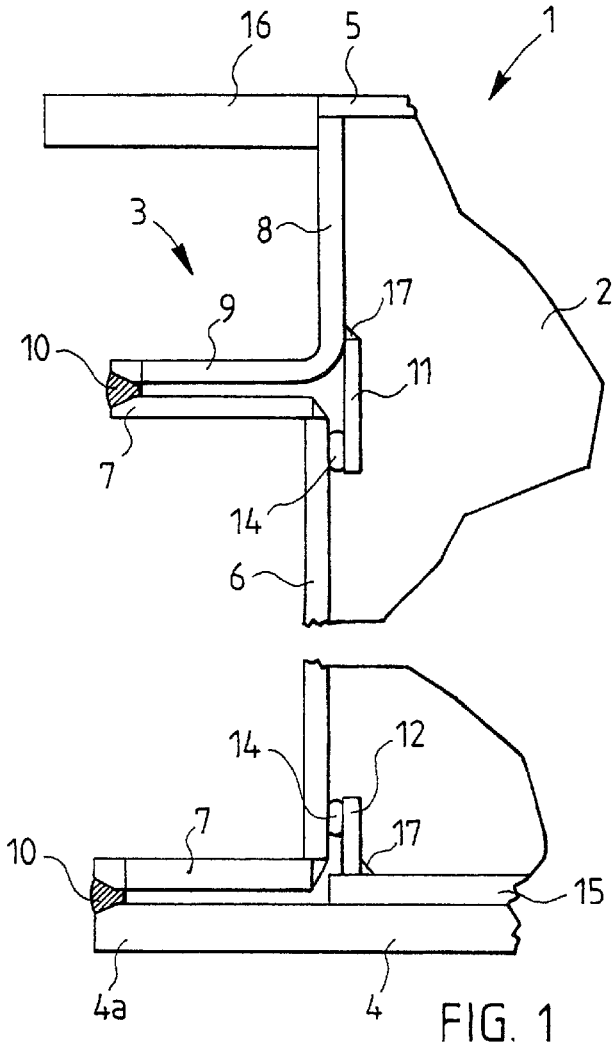

This application is a Continuation of International Application PCT/FI00/00395 filed on May 4, 2000, which designated the U.S. and was published under PCT Article 21(2) in English.

BACKGROUND OF THE INVENTION

The invention relates to a transformer comprising a transformer tank generally shaped like a rectangular prism and filled with insulating liquid and assembled mainly by welding and comprising four substantially vertical walls and two substantially horizontal walls, one of which is a detachably fastened transformer cover plate, and a transformer core placed in the transformer tank while the cover plate is detached.

Although the transformer of the invention can be applied in all normal operational environments, it is particularly suitable for use in confined surroundings, such as ships. The transformer is suitable for use for example as what is known as a transformer for internal consumption with which the voltage generated by a ship's generators is lowered to the level of 230/400 V.

The use of a conventional oil-insulated transformer onboard a ship is restricted by the fact that the transformer core has to be lifted out of the tank during malfunction, whereby it requires vertical space that is about twice the height of the transformer. Furthermore, the 'intermediate floor' above the transformer has to be made solid enough so that the core supported by the floor can be lifted out of the tank with a pulley.

Onboard ships, air-insulated dry transformers are quite generally used, whereby free space above the transformer is not necessarily required, since the transformer is not placed in a closed tank, but is only protected by a casing which can be removed on site from around the transformer core during malfunction. Furthermore, such type of a transformer is by definition fireproof. However, the structure of an air-insulated dry transformer is more expensive than a conventional transformer using oil or some other insulating liquid as insulation. A frequently used solution is a conventional tank structure of a supply transformer with an upper space designed so as to allow freeing the lifting space in order to repair the transformer.

SUMMARY OF THE INVENTION

It is an object of the present invention to provide a transformer whose tank, containing oil or another insulating liquid, can be opened to allow a fault in the transformer core to be repaired without the transformer core having to be lifted out of the tank, whereby no free space above the transformer is needed. This object is achieved with the transformer of the invention, which is characterized in that at least one of the substantially vertical walls of the transformer tank comprises a detachable wall portion whose detachment allows the transformer core to be removed from the transformer tank through an opening formed during the detachment of the wall portion. Consequently, the transformer of the invention can be repaired by opening the side of the transformer tank and by pulling the core out without any need for more vertical space during repairs than during normal operation of the transformer.

In accordance with the above, an essential feature of the transformer of the invention is that, except for the tank, it is composed of standard components and can be assembled mainly by the same working methods that are applied in the assembly of standard transformers (lifting the core into the tank, oil filling). Since a transformer very rarely breaks down, it is economically significantly more advantageous to modify a conventional transformer in the manner described in the invention to a transformer which fits into low spaces, such as ships, than to design a completely different transformer structure for use in ships.

In a preferred embodiment, the detachable wall comprises an edging that projects outwardly from the level of the wall portion, i.e. outwards from the inside of the transformer tank, the transformer tank wall surrounding the detachable wall portion comprises an edging corresponding to the edging of the detachable wall, and the edging of the detachable wall portion and the edging of the transformer tank wall surrounding the detachable wall portion are welded liquid-tightly together at their outer edges, allowing the detachment of the wall portion by cutting off the outer edge of the edgings. Accordingly, in the transformer of the invention, the tank is assembled by welding, and the detachable wall portion is also fastened by welding to the rest of the tank casing, i.e. in practice the bottom plate, to the residual part of one of the short sides and the plates of the long sides. Since the transformer very unlikely breaks down, the detachable wall portion can also be fastened by welding and, when needed, opened by an angle cutter. When the detachable wall portion is fastened in the aforementioned manner, the entire seam fastening the detachable wall portion can be cut off when the wall portion is detached, and the seam can be made in a new place when the tank is reassembled.

To prevent debris originating from the detachment or fastening of the wall portion from entering inside the transformer, the transformer tank wall surrounding the detachable wall portion comprises sealing lining arranged inside the transformer tank, against which the surface of the detachable wall portion that is on the inside of the transformer tank is sealed.

In order for easy and simple removal of the transformer core from the transformer tank, it is preferable that the transformer core is adapted to rest on a glide plate, allowing the transformer core to be pulled out from the transformer tank resting on the glide plate.

Furthermore, it is preferable that one or more fasteners to allow the transformer core to be pulled out from the transformer tank together with the detachable wall portion are arranged between the transformer core and the detachable wall portion.

LIST OF THE FIGURES

Figure 2:
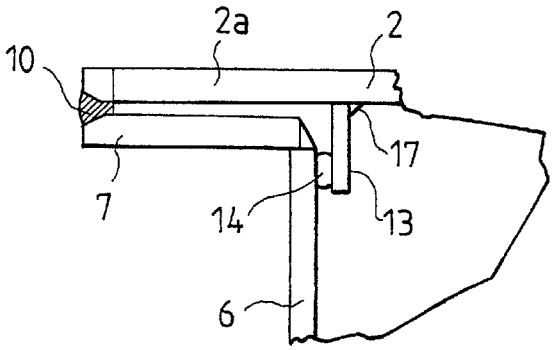

In the following the transformer of the invention will be described in more detail with reference to the attached drawing, in which FIG. 1 is a cross section of an end provided with a detachable wall portion according to an exemplary embodiment of the transformer of the invention, and FIG. 2 is a cross section of a part of an exemplary embodiment of the transformer of the invention, wherein the detachable wall portion is attached to the vertical wall of the transformer.

DETAILED DESCRIPTION OF THE INVENTION

In the transformer of the invention, the transformer tank is so constructed that its one end wall can be detached, when desired: The tank itself, denoted by reference 1 in FIG. 1 and shown only partly, is generally shaped like a rectangular prism and comprises four substantially vertical walls, of which FIG. 1 shows a side 2 and an end 3 and two substantially horizontal walls, i.e. a bottom 4 and an upper side 5 surrounded by what is known as a neck ring 16. The transformer tank 1 is preferably constructed so as to be vacuum-resistant in order for the tank to be able to be emptied of air before being filled with an insulating liquid, such as oil, after the transformer core has been repaired on site. The transformer tank 1 is also provided with pipefiftings to which a circulation circuit for insulating/cooling liquid, connected to an oil/water heat exchanger and controlled by a pump is connected. To increase security, said cooling circuit can be implemented doubled. Furthermore, an expansion tank is placed above the transformer. For the sake of clarity, these conventional transformer components-are not shown in the figures. The tank 1 itself is assembled mainly by welding, and the special feature of the invention, i.e. the detachable wall portion 6, is also fastened by welding.

FIG. 1 shows a cross section of the transformer tank 1 according to the invention, and particularly its end 3, to which the detachable wall portion 6 is arranged. Said wall portion 6 comprises an edging 7 which surrounds the wall portion 6 and extends away from the transformer tank 1. At said edging, the wall portion 6 is fastened by welds 10 to an end edge 4*a* of the bottom plate 4 of the tank, to edge parts 2*a* (FIG. 2) of the side plates 2, and to an edging 9 also extending outwardly from the inside of the tank 1 and formed in connection with a wall portion 8 extending downwardly from the upper side 5 of the transformer at the upper part of the transformer. In this way the edge parts 2*a*, 4*a* and 9, corresponding to the edging 7 attached to the wall portion 6, surround all four sides of the wall portion 6, which can be welded to said parts from outside.

As FIGS. 1 and 2 show, the welds 10, and, accordingly, the wall portion 6, can be easily detached by breaking the edgings 7 and the thereto parallel other side portions of the transformer tank with for example an angle cutter, for instance immediately behind the weld 10 on the side of the tank 1. In this way the wall portion 6 can be detached efficiently and simply from the transformer tank parts surrounding it.

In order to prevent sparkles, which might damage the core, or metal particles, which would mix with the insulating liquid, from entering the transformer tank when the wall portion 6 is being detached and, also, when the wall portion 6 is being welded back after the core has been repaired, the transformer tank wall surrounding the detachable wall portion comprises sealing lining 11, 12, and 13 which are arranged inside the transformer tank and against which the side of the detachable wall portion 6 on the inside of the transformer tank 1 is sealed with heat-resistant sealing strips 14. Said sealing lining 11, 12 and 13 are welded with welds 17 to the wall and bottom structures of the transformer tank I surrounding the detachable wall portion 6.

When the transformer is being assembled, and the transformer former tank 1 is assembled, a glide plate 15 is installed at the bottom of the tank and is suitably locked in place with respect to the transformer tank. Said glide plate 15 is also fastened for example with bolts (not shown) to the detachable wall portion 6. This serves to allow the transformer core, resting on the glide plate 15, to be pulled out of the transformer tank together with the detachable wall portion 6.

In case of malfunction of the transformer on site, it is first de-energized, whereupon the insulating liquid, such as oil, is discharged from it. If necessary, the expansion tank is detached from above the transformer, and the cover plate of the transformer is screwed open. The coil conductors of the transformer are then detached from the bushing insulator. The transformer core is also detached from the fastening points on the sides of the tank. The detachable wall portion 6 of the transformer is then cut with for example an angle cutter by cutting off the edgings 7 and the thereto-parallel transformer tank edgings. The transformer core, resting on the glide plate 15, is then pulled out of the transformer tank together with the wall portion 6 for example with a pulley from loops (not shown) attached to the detachable wall portion. A plane surface must naturally be placed below the glide plate 15 outside the transformer flush with the bottom plate 4 of the transformer tank. Once the repair work is finished, the transformer core is pushed back in place. The detachable wall portion is then welded in place, the coil conductors coupled to the bushing insulators and the cover plate screwed in place. When the transformer is then dried and filled with oil, it is again ready for use.

In the above, the transformer of the invention has been described only with reference to an exemplary embodiment, and it should be understood that a variety of structural changes can be made thereto without, however, departing from the scope defined by the attached claims.

What is claimed is:

1. A transformer housing for receiving an insulating liquid and a transformer core in an interior thereof comprising:

a transformer tank generally shaped like a rectangular prism assembled by welding including:

at least one substantially vertical wall portion having upper and lower ends, and a detachable portion for forming an opening in the transformer tank, the first and second substantially horizontal wall portions respectively engaging the first and second ends of the at least one vertical wall portion, at least one of said horizontal walls being detachably fastened to one of said first and second ends, said detachable portion includes a first edging projecting therefrom in a direction outwardly of the interior of the transformer tank and having a corresponding outer marginal edge, and the at least one vertical wall portion includes a first edging having a corresponding outer marginal edge, said first edgings for engaging each other and being welded liquid-tight together at the corresponding outer marginal edges thereof, and wherein detachment of said detachable portion being facilitated by cutting off the welded outer marginal edges of the first edgings.

2. A transformer housing as claimed in claim 1, wherein the transformer tank wall further comprises a sealing lining arranged inside the transformer tank, against which the detachable portion is sealed.

3. A transformer housing as claimed in claim 1, including a glide plate, secured within the housing and being slidably removable from the transformer tank.

4. The transformer housing of claim 1 wherein the at least one vertical wall portion includes a second edging having a corresponding marginal edge and the detachable horizontal wall has a corresponding marginal edge welded to the marginal edge of the second edging.

5. A transformer housing for receiving an insulating liquid and a transformer core in an interior thereof comprising:

a transformer tank including:

at least one substantially vertical wall portion having upper and lower ends, and a detachable portion for forming an opening in the transformer tank, the first and second substantially horizontal wall portions respectively engaging the first and second ends of the at least one vertical wall portion, at least one of said horizontal walls being detachably fastened to one of said first and second ends, said detachable portion includes a first edging projecting therefrom in a direction outwardly of the interior of the transformer tank and having a corresponding outer marginal edge, and the at least one vertical wall portion includes a first edging having a corresponding outer marginal edge, said first edgings for engaging each other and being welded liquid-tight together at the corresponding outer marginal edges thereof, and wherein detachment of said detachable portion being facilitated by cutting off the welded outer marginal edges of the first edgings.

* * * * *